US007708536B2

(12) United States Patent
Ginies et al.

(10) Patent No.: US 7,708,536 B2
(45) Date of Patent: May 4, 2010

(54) SCROLL-TYPE REFRIGERANT COMPRESSOR HAVING FLUID FLOWING FROM GAS INLET TO MOTOR WINDING END CHAMBER THROUGH INTERMEDIATE JACKET

(75) Inventors: Pierre Ginies, Sathonay Village (FR); David Genevois, Cailloux sur Fontaine (FR); Alexandre Montchamp, Moins (FR)

(73) Assignee: Danfoss Commercial Compressors, Trevoux (FR)

( * ) Notice: Subject to any disclaimer, the term of this patent is extended or adjusted under 35 U.S.C. 154(b) by 15 days.

(21) Appl. No.: 11/918,717

(22) PCT Filed: May 23, 2006

(86) PCT No.: PCT/FR2006/001176

§ 371 (c)(1),
(2), (4) Date: Oct. 18, 2007

(87) PCT Pub. No.: WO2006/125909

PCT Pub. Date: Nov. 30, 2006

(65) Prior Publication Data

US 2009/0035168 A1 Feb. 5, 2009

(30) Foreign Application Priority Data

May 23, 2005 (FR) ..... 05 05153

(51) Int. Cl.
*F03C 2/00* (2006.01)
*F04C 18/00* (2006.01)
*F04C 2/00* (2006.01)

(52) U.S. Cl. ..... 418/55.6; 418/55.1; 418/94; 418/100; 418/270; 418/DIG. 1; 417/366; 417/410.5; 184/6.18

(58) Field of Classification Search ..... 418/55.1–55.6, 418/57, 88, 94, 270, DIG. 1, 100; 184/6.16–6.18; 417/310, 366, 368, 410.5
See application file for complete search history.

(56) References Cited

U.S. PATENT DOCUMENTS

| | | | | |
|---|---|---|---|---|
| 4,749,344 | A * | 6/1988 | Tomita et al. | 418/55.6 |
| 4,928,503 | A * | 5/1990 | Riffe | 418/55.6 |
| 6,135,738 | A * | 10/2000 | Kajiwara et al. | 418/55.6 |
| 6,814,551 | B2 * | 11/2004 | Kammhoff et al. | 418/55.1 |
| 2003/0063986 | A1 | 4/2003 | Ginies et al. | |
| 2004/0126261 | A1 | 7/2004 | Kammhoff et al. | |

FOREIGN PATENT DOCUMENTS

| | | |
|---|---|---|
| FR | 2 830 292 | 4/2003 |

* cited by examiner

*Primary Examiner*—Theresa Trieu
(74) *Attorney, Agent, or Firm*—Oliff & Berridge, PLC

(57) ABSTRACT

A scroll-type refrigerant compressor with a sealed enclosure defined by a shell and containing a suction volume and a compression volume at opposite ends of the enclosure. The shell has a gas inlet, an electric motor on the suction side having a stator and defining with the shell an annular volume. The stator is surrounded by a jacket defining an annular volume with the shell and a chamber which contains the motor winding and is directed towards the compression volume, an end of the intermediate jacket directed away from the compression volume being located at an end of the stator directed away from the compression volume. Structure is provided for conveying some of the gas arriving at the gas inlet into the chamber containing the motor winding, and gas conveyed by the structure is admitted into the chamber containing the winding through the gas intake orifice.

10 Claims, 6 Drawing Sheets

SCROLL-TYPE REFRIGERANT COMPRESSOR HAVING FLUID FLOWING FROM GAS INLET TO MOTOR WINDING END CHAMBER THROUGH INTERMEDIATE JACKET

The present invention relates to a scroll-type refrigerant compressor.

A scroll-type compressor (or scroll compressor) comprises a sealed enclosure defined by a shell containing a suction volume and a compression volume, the two being separated by a compression stage, and being situated one at each end of the enclosure. The shell comprises a refrigerant gas inlet.

An electric motor is mounted inside the suction volume, with a stator on the outside, stationary with respect to the shell, and a rotor in the center, connected to a drive shaft or crankshaft. The drive shaft contains an off-axis lubrication channel running all the way along its length and supplied with oil from a sump situated in the bottom of the enclosure by an oil pump arranged at a first end of the shaft. The lubrication channel comprises lubrication orifices for the various guide bearings of the shaft.

The compression stage contains a stationary volute equipped with a scroll engaged in a scroll belonging to a moving volute. The two scrolls define at least one variable-volume compression chamber. The second end of the drive shaft is equipped with a crank which drives the moving volute in an orbital movement to compress the suction gas.

Depending on the internal flow configuration of this type of compressor, the refrigerant gas entering the compressor may pick up oil. The oil may come from, for example, bearing leaks, or be swept up off the surface of the oil supplied by the gas, even if speeds are relatively low and especially if the oil/refrigerant mixture contained in the oil supply foams up.

Depending on the operating conditions of this type of compressor, the amount of oil in the refrigerant gas leaving the compressor may become excessive. The direct consequence of this excessive amount of oil in the gas is a loss of heat exchange efficiency in the heat exchangers situated downstream of the compressor. This is because oil droplets carried in the gas tend to deposit on the heat exchangers and form a layer of oil on the exchangers.

Moreover, an excessive amount of oil in the gas can also drain the supply of oil in the sump, which could lead to destruction of the compressor.

To alleviate these various situations, systems for separating the oil/gas mixture already exist.

One existing oil/gas mixture separating system is disclosed in document US 2004/0126261.

In that document, the motor is entirely mounted inside a tube which, being fixed to the body separating the suction and compression volumes, serves as a mounting for the motor. The tube defines on the one hand an annular volume with the shell, and on the other hand a chamber which contains the motor winding end and is directed towards the compression volume. A first opening is formed in the tube, between the body and the motor, to convey gas arriving through the gas inlet formed in the shell, into the chamber containing the winding end. A second opening is formed on the motor side away from the compression volume so that gas can pass out of the tube into the annular volume between the tube and the shell.

From a practical point of view, gas arrives from the outside and passes directly into the chamber containing the motor winding end and flows towards the end of the shell furthest from the compression volume. The flow occurs mostly between the rotor and the stator, and also at the periphery of the stator, between the stator and the tube containing the stator. Gas arriving from the sump area then passes through the second opening and into the annular volume between the tube and the shell. A deflector is arranged in front of the second opening to modify the direction and speed of the gas. These modifications of direction and speed of the gas cause the oil/gas mixture to separate out, the gas moving towards the compression stage where it is sucked in, and the oil draining under gravity into the oil sump.

In order to be able to operate, this system requires a sudden change of direction of the gas and an adjustment to the gas speeds to produce optimal separation of the oil/gas mixture.

As a result, in variable-capacity operation, this type of separator suffers from reduced efficiency: at high flow rates, because of the high speeds of the gases, the oil/gas separation time is much shorter, which means that particles of oil can be swept up again into the gas flow after separation.

Also, the movement of the gas/oil mixture through the outlet opening or openings of the tube causes the oil/gas mixture to accelerate locally, which is prejudicial to separation of the mixture.

It should be noticed that the lower counterweight of the motor creates turbulence in the lower end of the tube. This turbulence reduces the efficiency of separation of the oil/gas mixture.

It is therefore an object of the present invention to solve these problems.

The technical problem which the invention is intended to solve is how to provide a scroll-type refrigerant compressor in which there is efficient oil/gas separation under all conditions of operation of the compressor.

To this end, the compressor to which it relates, comprising:

- a sealed enclosure defined by a shell and containing a suction volume and a compression volume at opposite ends of the enclosure, one on either side of a body, the shell comprising a refrigerant gas inlet, and
- an electric motor on the suction side having a stator and defining with the shell an annular volume, and a rotor connected to a drive shaft in the form of a crankshaft, a first end of which drives an oil pump supplying oil from a sump in the bottom of the enclosure to a channel formed in the central part of the shaft,
- the compression volume containing a stationary volute equipped with a scroll engaged in a scroll of a moving volute, the two scrolls defining at least one variable-volume compression chamber, and
- the second end of the drive shaft being equipped with a device driving the moving volute in an orbital movement to compress the suction gas, is characterized in that the stator is surrounded by an intermediate jacket defining on the one hand an annular volume with the shell and on the other hand a chamber which contains the motor winding end and is directed towards the compression volume side, that end of the intermediate jacket directed away from the compression volume being located at that end of the stator which is directed away from the compression volume or set back therefrom, while means are provided for conveying at least some of the gas arriving at the gas inlet formed in the shell, into the chamber containing the winding end.

The gas flows around the motor in the following manner: at least some of the gas enters the chamber containing the motor winding end and re-emerges, after passing between the rotor and the stator, at the winding end furthest from the compression volume. Lubricating oil-laden gas flowing in contact with the motor encourages the return of this lubricating oil to the oil sump, and promotes cooling of the motor. After this, the gas flow diffuses into a large annular volume between the oil sump and the winding end furthest from the compression volume. The gas flow then moves into the annular volume between the stator and the shell, and the annular volume between the shell and the chamber containing the winding end, before reaching the compression stage, into which it is sucked.

While the gas is flowing through the motor airgap, it is flowing through a small volume, the effect of which is to increase the gas flow speed. Then, as the gas leaves the motor airgap it diffuses suddenly into a very large annular volume. This sudden change to the cross section of the gas flow causes a large drop in the speed of the gas flow.

Furthermore, the diffusion of the gas into the annular volume between the oil sump and the end of the motor furthest from the compression volume also involves a change in the direction of the gas flow.

The effect of these changes of speed and direction is to efficiently separate the oil/gas mixture, the gas flowing on towards the compression stage and the oil draining under gravity into the oil supply.

Additionally, because of the large size of the annular volume between the oil sump and the motor end furthest from the compression volume, the speeds reached by the gas as it passes out of the motor will remain slow even when the compressor is being used in variable capacity.

The oil/gas separation will therefore continue to be efficient under all conditions of operation of the compressor.

It should be observed that as the gas carries away the heat from the motor, it will heat up the shell on its way through the annular space. Some of the thermal losses of the motor can thus be discharged directly through the outside of the compressor, reducing the overheating at the volute intake, which reduces the performance of the compressor.

Lastly, the droplets of lubricating oil moving over the motor on their way back to the sump cool the motor and discharge the thermal losses through the compressor sump. Since the oil is hotter, it contains less dissolved refrigerant fluid and maintains greater lubricating power.

In general terms, the overheating at the suction into the volutes is lowered, and because of the potential use of the by-pass the total pressure loss between the suction connection and the volute suction will be lower and beneficial to the efficiency of the compressor.

In a first embodiment of this compressor, that part of the motor which is situated on the compression volume side is mounted inside a tube forming the intermediate jacket which, being mounted on the body separating the suction and compression volumes, forms a mounting for the motor, an orifice being formed in the tube, between the body and the motor, to admit refrigerant gas.

In another embodiment of this compressor, the body separating the suction and compression volumes comprises, on the motor side, a tubular extension forming the intermediate jacket and serving as a housing and mounting for one end of the motor, an orifice being formed in the tubular extension of the body to admit refrigerant gas.

In a third embodiment of this compressor, the motor is mounted on the shell, and its upper end is covered by a cap forming the intermediate jacket in which an orifice is formed to admit refrigerant gas.

In accordance with one feature of the invention, the means for conveying the refrigerant gas from the inlet orifice formed in the shell are a tubular sleeve connecting the orifices formed respectively in the shell and in the intermediate jacket which defines the chamber containing the winding end.

The sleeve advantageously comprises a first tubular part mounted on the shell or on the intermediate jacket covering the end of the motor, and a second tubular part which slides on the outside of the latter and is subject to the action of a spring that pushes it towards the part on which the first tubular part is not mounted.

This arrangement makes it possible to absorb differential expansions between the different components, and tolerances between parts and tolerances in the assembly process.

In accordance with one feature of the invention, the means conveying the refrigerant gas into the chamber containing the winding end comprise a by-pass for some of the gas flow to pass directly into the annular volume between the motor and the shell.

The by-pass is also calculated so that the gas flow rate passing through the motor is equal to the flow rate necessary to cool the motor and minimizes pressure loss.

In accordance with one feature of the invention, there is formed in the body at least one opening connecting the chamber containing the winding end to the area containing the drive shaft bearings situated on the compression volume side.

The compressor advantageously comprises control means to allow it to be driven by the variable-speed motor.

The principal axis of rotation of the drive shaft may be vertical, or inclined in a position between horizontal and vertical.

The invention will be clearly understood from the following description, which refers to the accompanying schematic drawing showing, by way of non-restrictive examples, a number of embodiments of this compressor.

In the following description, recurring components are denoted by the same references in all embodiments.

Figure 1:
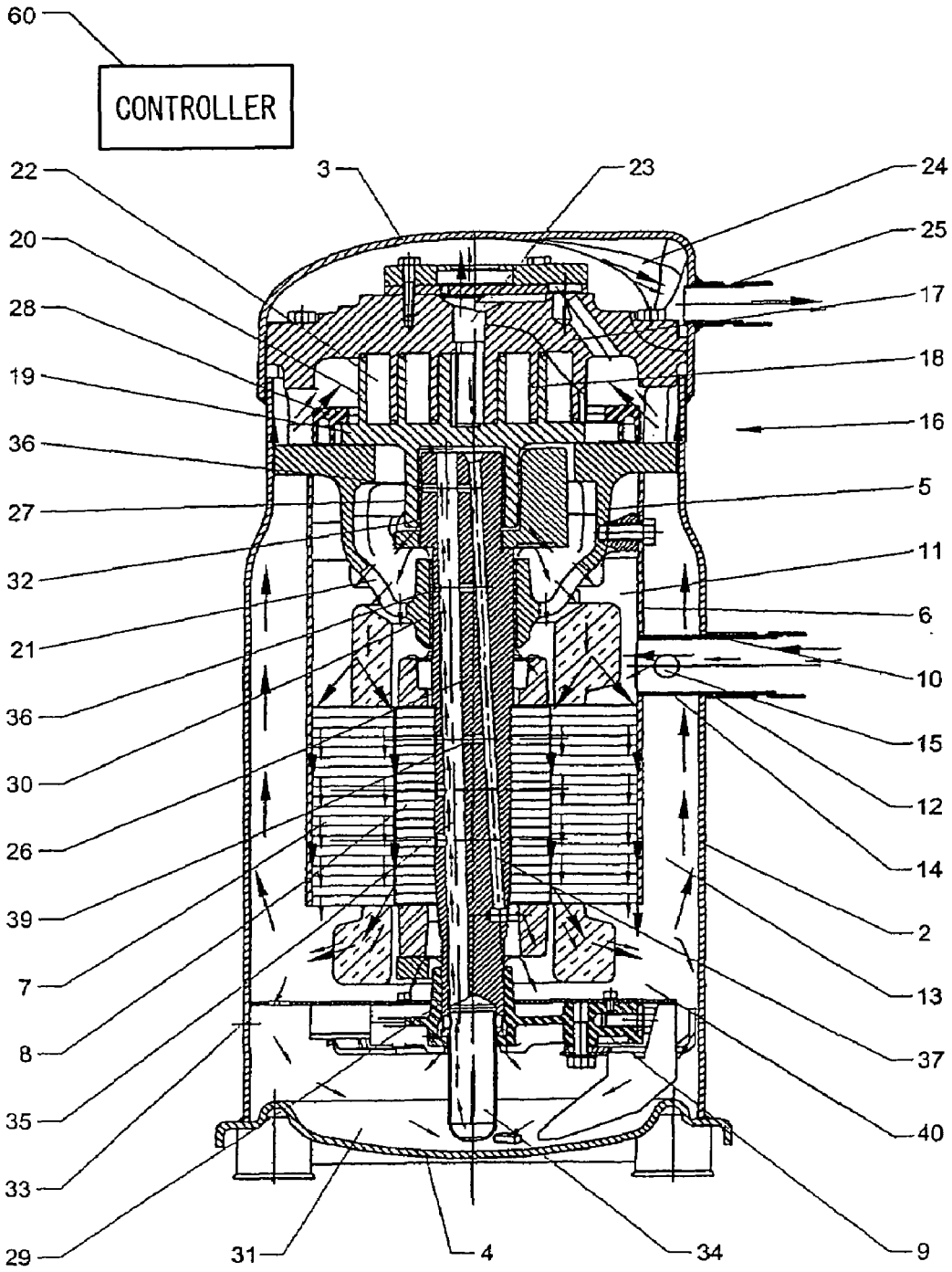
FIG. 1 is a view in longitudinal cross section through a first compressor.

FIG. 1 shows a scroll refrigerant compressor occupying a vertical position. However, the compressor according to the invention can be placed in an inclined position, or a horizontal position, without modifying its structure.

The compressor shown in FIG. 1 comprises a sealed enclosure defined by a shell 2 whose upper and lower ends are closed by a cover 3 and a base 4, respectively. The intermediate part of the compressor is occupied by a body 5 that defines two volumes, a suction volume underneath the body 5, and a compression volume above. Mounted on the body is a tube 6, and inside the tube is mounted an electric motor comprising a stator 7 with a rotor 8 in the center. The tube 6 may for example be crimped to the stator to support the motor. The lower end of the tube 6 is situated at the lower end of the stator 7.

An orifice 10 is formed in the shell 2 and connected to a connector 12 to admit gas into the compressor. This connector 12 opens into an annular volume 13 between the shell 2 and the tube 6 containing the motor, at the top of the motor.

The connector 12 is extended through the annular volume 13 by a sleeve 14 which passes through this annular space and opens into an upper chamber 11, defined by the tube 6, which contains the motor winding end. There is a by-pass opening 15 in the sleeve 14 where it passes through the annular volume 13.

The body 5 serves as a mounting for the gas compression stage 16. This compression stage comprises a stationary volute 17 equipped with a downward-facing stationary scroll 18, and a moving volute 19 equipped with an upward-facing scroll 20. The two scrolls 18 and 20 of the two volutes fit one inside the other to create variable-volume compression chambers 22. Gas enters from the exterior: the compression chambers 22 have a variable volume which decreases from the outside in as the moving volute 19 moves relative to the stationary volute 17, and the compressed gas escapes from the center of the volutes through an opening 23 leading into a chamber 24 from which it is discharged via a connector 25.

The rotor 8 is coupled to a shaft 26 whose upper end is off-axis, like a crankshaft. This upper end is engaged in a bush part 27 of the moving volute 19. As it is turned by the motor, the shaft 26 drives the moving volute, which is guided by a connecting piece 28 relative to the stationary volute 17, in an orbital movement.

The shaft 26 is guided relative to the other parts by a lower bearing 29 formed in a centering piece 9 mounted on the shell 2, then via an intermediate bearing 30 formed in the body 5, and then via an upper bearing 32 formed between the shaft 26 and the bush 27. The volume containing the upper bearing 32 communicates with the chamber 11 through openings 21 in the body 5.

The base 4 defines a sump 31 containing the oil, the oil level being shown by reference 33. The oil bath bathes the end of the pump intake channel 34, which supplies lubricating oil to the various bearings along a channel 35 which is inclined with respect to the shaft axis and which leads to the shaft end adjacent to the moving volute 19 as well as through orifices 36 level with the bearings, for their lubrication. At the top, lubricating oil can return to the sump by trickling through the openings 21 in the body 5 and through interstices running through the motor, allowing the oil leaking from the bearings 30, 32 and from the moving volute 19 to trickle down toward the motor, thereby increasing the amount of oil passing through it.

In FIG. 1, large arrows represent gas flow, small arrows represent oil flow.

In the embodiment depicted in the drawing, the shaft 26 also includes an oil return channel 37, which may be parallel to or inclined with respect to the shaft axis, with one open end at the moving volute shaft end, in the center of the shaft, and the other open end in the peripheral wall of the shaft, at the bottom of the motor.

The return channel 37 advantageously communicates with the lubrication channel 35 through a number of transverse orifices 39 to promote degassing of the oil supplying the bearings.

Figure 2:
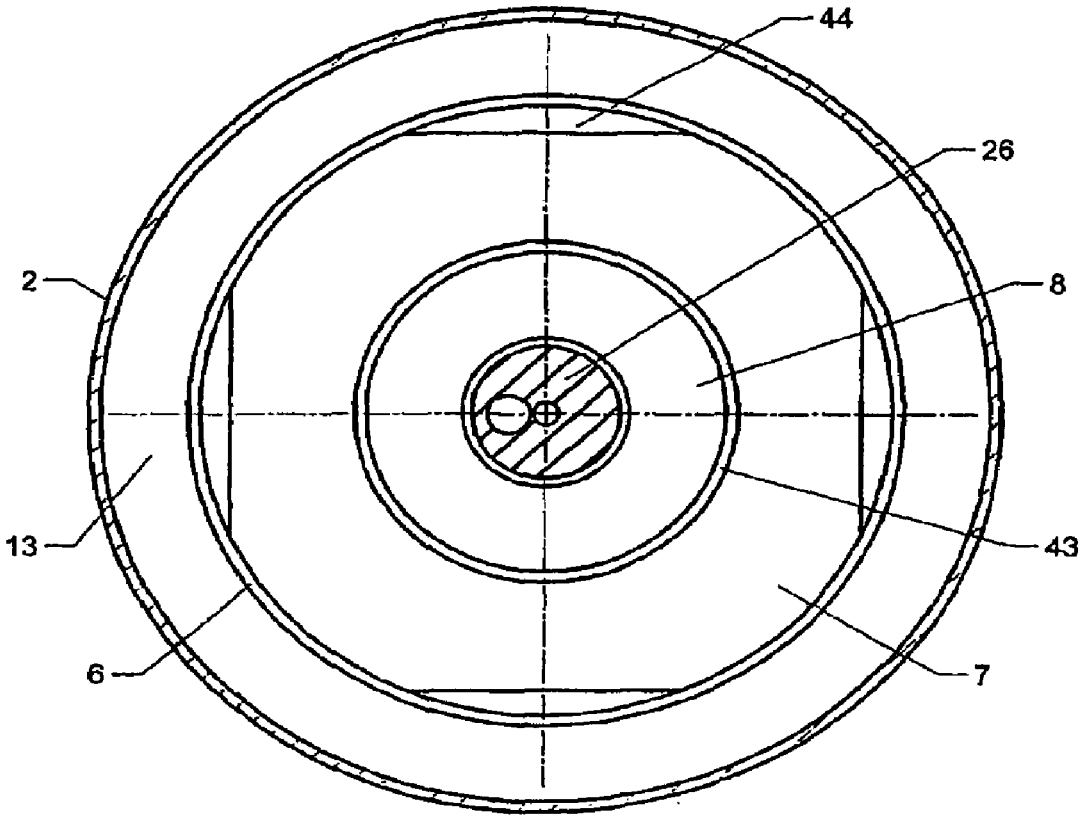
FIG. 2 is a view in transverse cross section through the electric motor and through the tube surrounding it.

Operation of this compressor is as follows: refrigerant gas carrying oil and potentially liquid particles arrives through the connector 12. A large part of the gas flow passes through the sleeve 14 into the volume defined by the tube 6 above the motor. Another part of the flow passes through the by-pass channel 15 into the annular volume 13 to flow directly towards the compression stage 16. Gas arriving in the volume above the motor mixes with the lubricating oil flowing towards the lower bearing 29, particularly from the upper bearing 32 and from the intermediate bearing 30. The mixture of gas and lubricating oil travels downward through the motor, carrying away the thermal losses of the motor. Most of it passes through a gap 43 between the rotor and the stator, and through gaps 44 between the stator and the tube 6 in positions where there are flats on the stator, as shown in FIG. 2. The mixed flow passing down through the motor arrives at the bottom of the motor where the flow of oil from the lower bearing is added to it. The gas/oil mixture then diffuses into a large annular volume 40 situated between the centering piece 9 and the motor. The changes of direction and differences of speed cause the oil to be separated from the gaseous flow and fall back into the sump 31. The gaseous flow then travels up the annular volume 13 toward the compression stage 16. The separation of the gas and the oil continues during the journey up through the annular volume due to gravity and/or due to the controlled gas speeds and a calculated separation time.

The provision of an oil return channel 37 allows a high flow rate of oil to be removed, besides ensuring that it returns to the sump, irrespective of the flow rate applied by the pump and the speed of rotation. A large lubricating oil return flow rate is also a favorable factor in cooling the bottom of the motor.

The fact that the oil flow rate through the motor can be augmented by the flow rate via the openings 21 allows better cooling of the motor.

With this structure, and as indicated earlier, overheating of the refrigerant gas entering the volutes is lowered and the pressure loss is reduced. This structure is therefore particularly suitable for constructing high-efficiency compressors for refrigeration, air conditioning and variable speed. Variable speed can be achieved by driving the electric motor with the controller 60, an example of a control means.

Figure 3:
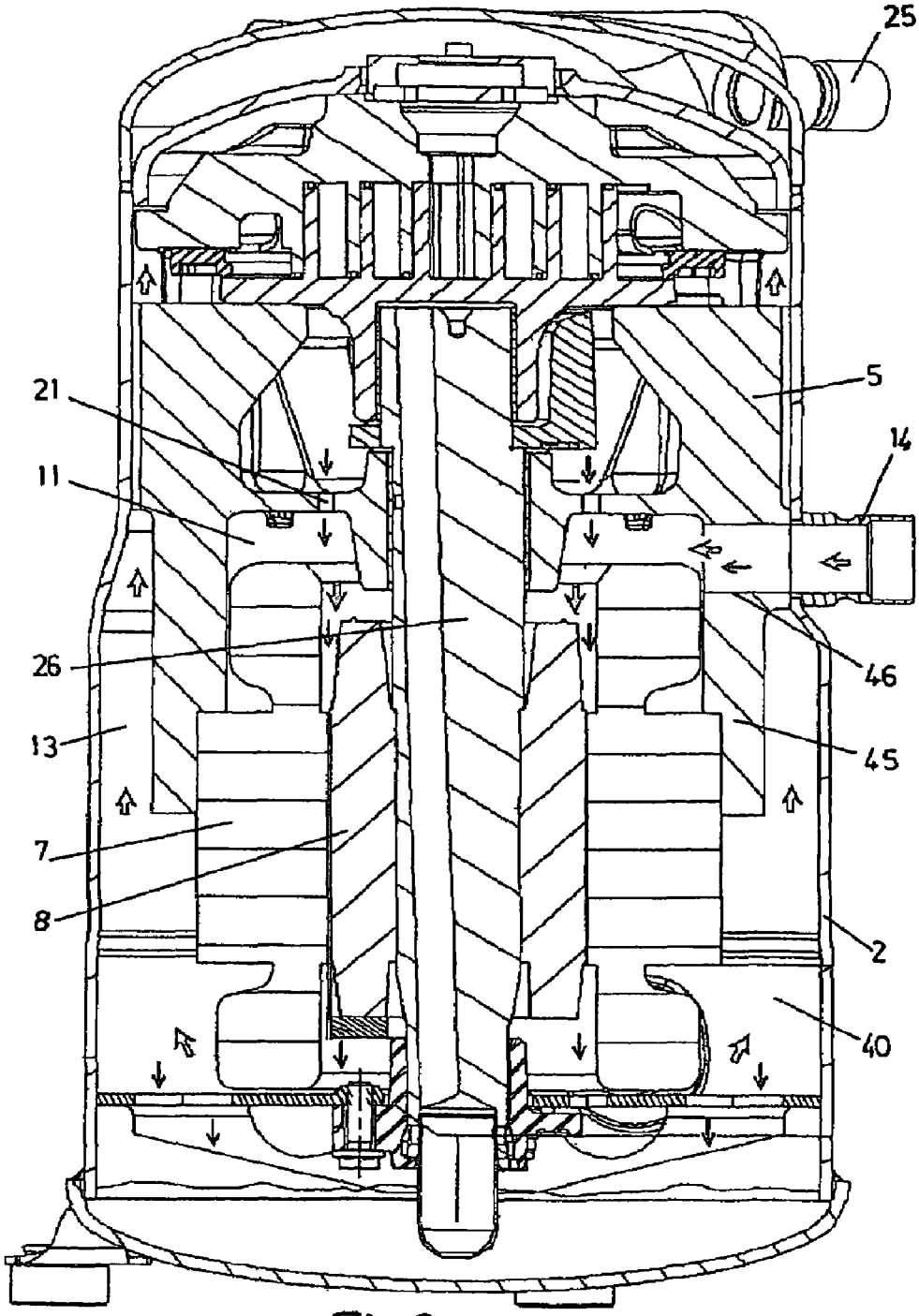
FIG. 3 is a view in longitudinal cross section through a second compressor in which the body possesses an extension in the direction of the motor.

FIG. 3 shows an alternative embodiment of the compressor seen in FIG. 1, in which recurring parts are denoted by the same references as before. In this compressor, the motor is not mounted on a tube. In this case, the body 5 comprises a downward tubular extension 45 which grips the upper end of the motor, for which it serves as a mounting, and which has an orifice 46 for the intake of gas through a sleeve 14.

Figure 4:
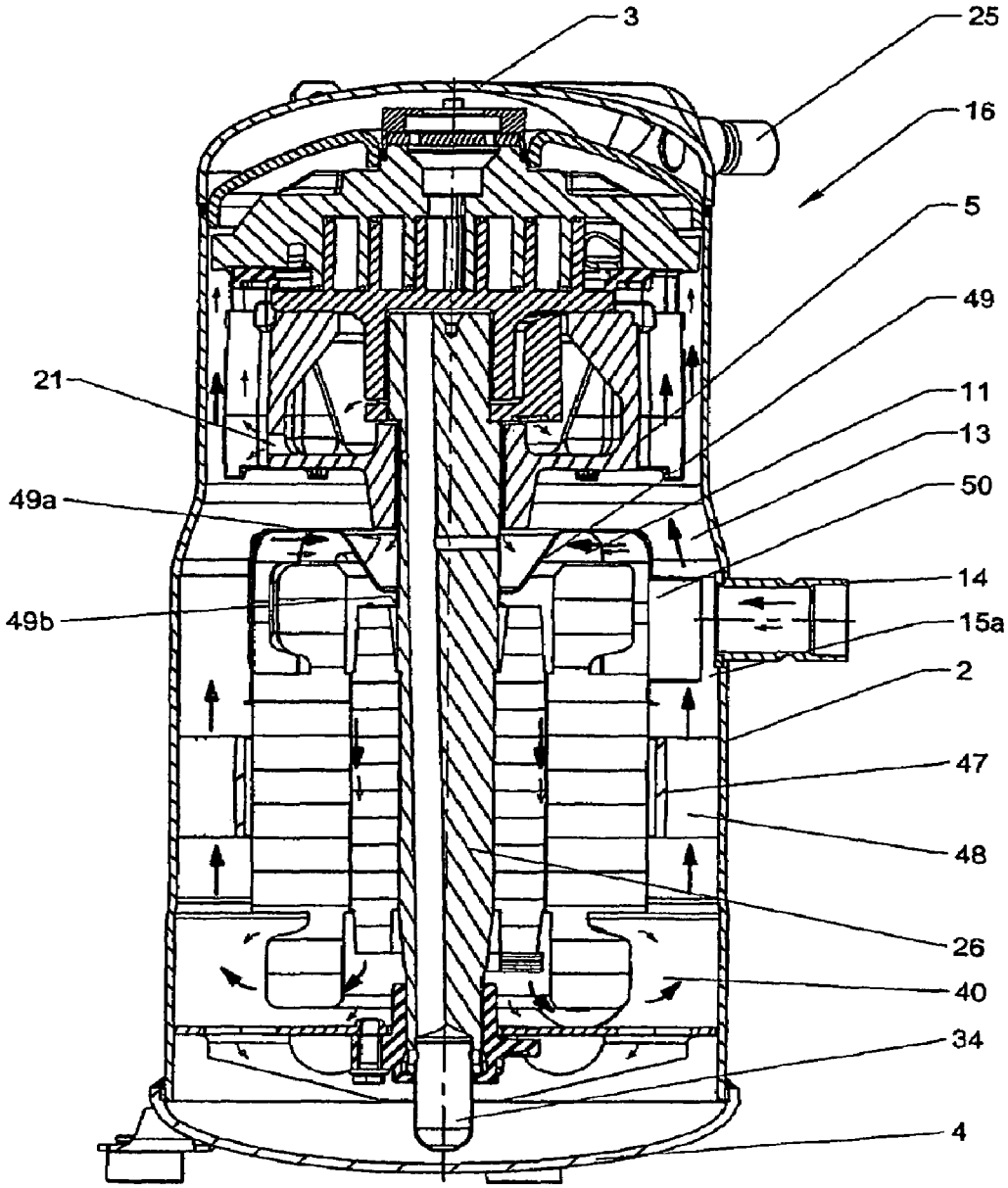
FIG. 4 is a view in longitudinal cross section through a third compressor.

In the embodiment shown in FIG. 4, the motor is mounted not on the body 5, but directly on the shell 2 via a collar 47 which encircles the stator and is connected to the shell 2 by spokes 48. In a case like this, the upper end of the motor is covered by a cap 49 defining the chamber 11, which is supplied with refrigerant gas through a sleeve 14 via an orifice 50. A space 15*a* between the sleeve 14 and the orifice 50 of the cap 49 forms a by-pass, allowing part of the fluid flow to enter the annular space 13 directly. In this form, the cap 49 may advantageously form a collector 49*a* of lubricating oil coming from the upper bearings of the crankshaft and allow oil to pass between the shaft and the center of the cap 49*b*: this lubricating oil then mixes with the refrigerant gas in the volume defined by the cap.

Figure 5:
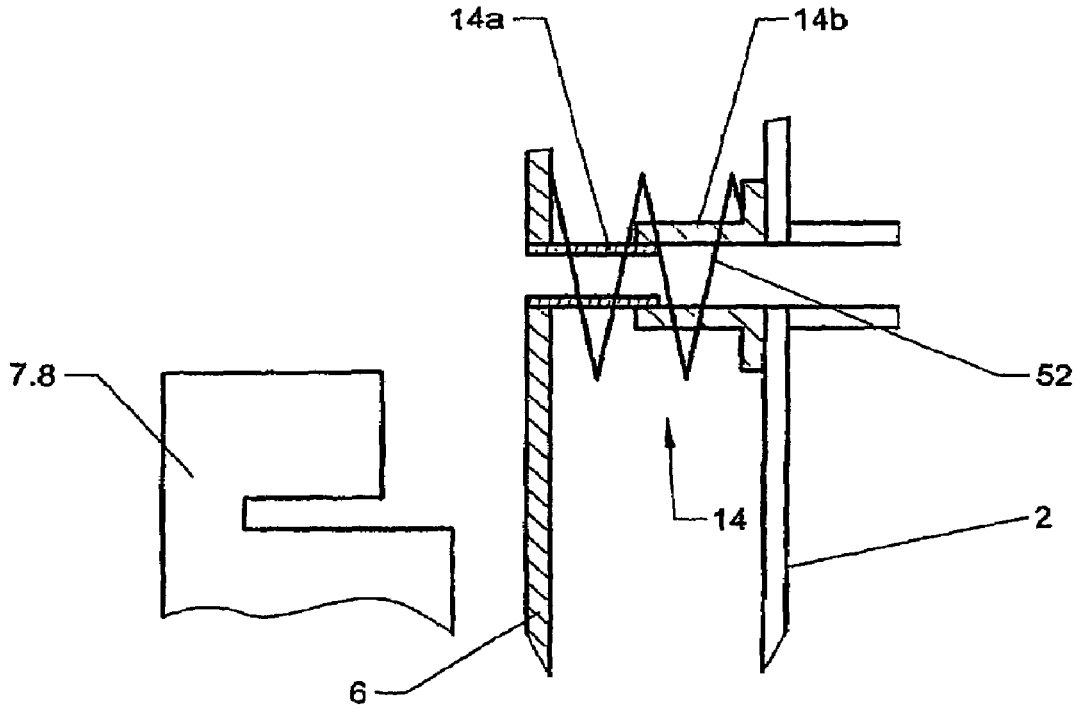
FIGS. 5 and 6 are two partial views, in cross section, through two methods of supplying refrigerant fluid to the motor compartment.
Figure 6:
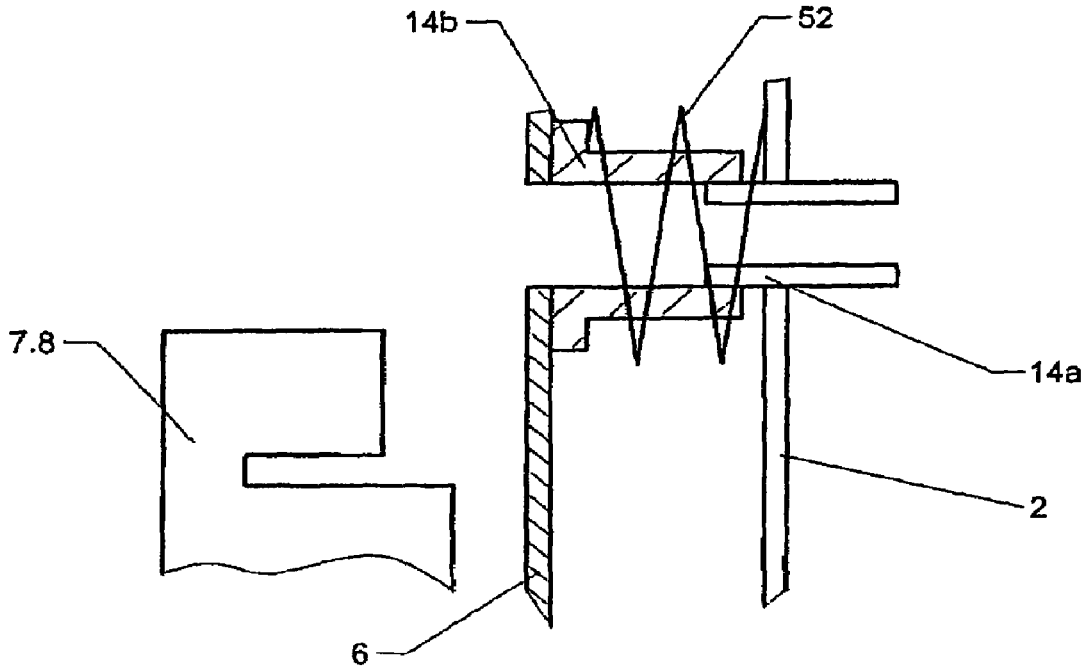

FIGS. 5 and 6 show two embodiments of the sleeve supplying gas to the chamber 11 containing the motor winding end. In FIGS. 5 and 6 the motor is shown schematically and indicated by references 7 and 8. FIGS. 5 and 6 show the sleeve used in the device of FIGS. 1 and 2, though this arrangement can be transferred to the embodiments shown in FIGS. 3 and 4. In the case of FIG. 5, the sleeve 14 comprises a tubular part 14*a* mounted on the tube 6, while there slides around it a tubular part 14*b* acted on by a spring 52 designed to push it against the wall of the shell 2.

FIG. 6 is an opposite arrangement: in this case the tubular part 14*a* is fixed to the shell 2 and guides the part 14*b* which is acted upon by the spring 52 to push against the outer wall of the tube 6.

Figure 7:
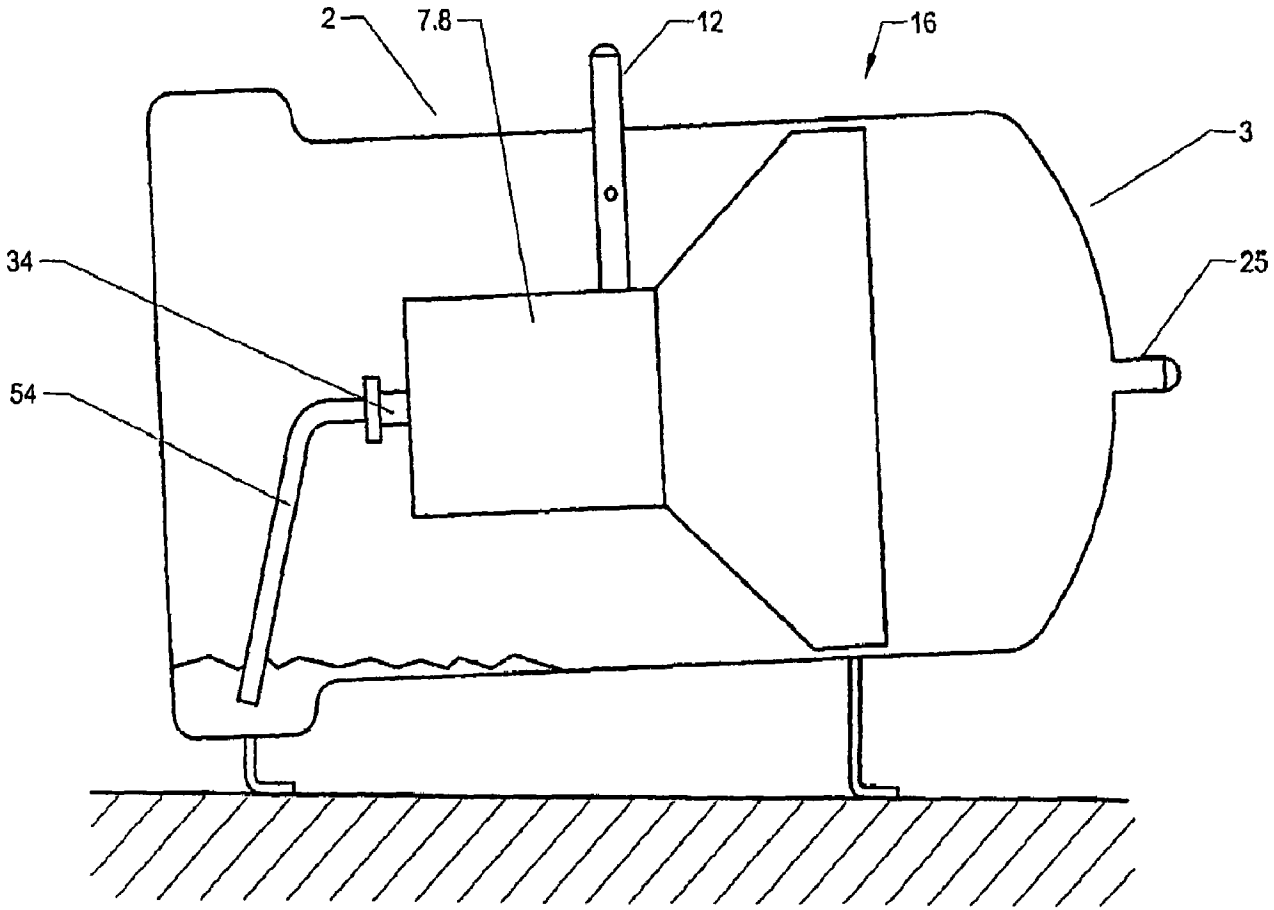
FIG. 7 is a schematic view of another compressor.

FIG. 7 shows an alternative embodiment of the compressor according to the invention, in which the principal axis of rotation of the drive shaft is essentially horizontal.

As a result of this position, the pump 34 is not immersed directly into the oil bath but is provided with a suction tube 54 whose end is in the oil, and the discharge tube 25 is in the center of the cover 3.

It goes without saying the invention is not limited to the embodiments of this compressor described above by way of examples: on the contrary it encompasses all alternative embodiments thereof. As a particular example, the compressor does not have to be vertical but can be inclined without thereby departing from the scope of the invention.

The invention claimed is:

1. A scroll-type refrigerant compressor comprising:

a sealed enclosure defined by a shell and containing a suction volume and a compression volume at opposite ends of the enclosure, one on either side of a body, the shell comprising a refrigerant gas inlet, an electric motor on the suction side having a stator and defining with the shell an annular volume, and a rotor connected to a drive shaft in the form of a crankshaft, a first end of which drives an oil pump supplying oil from a sump in the bottom of the enclosure to a channel formed in the central part of the shaft, the compression volume containing a stationary volute equipped with a scroll engaged in a scroll of a moving volute, the two scrolls defining at least one variable-volume compression chamber, and the second end of the drive shaft being equipped with a device driving the moving volute in an orbital movement to compress the suction gas, wherein the stator is surrounded by an intermediate jacket defining on the one hand an annular volume with the shell and on the other hand a chamber which contains the motor winding end and is directed towards the compression volume side, an end of the intermediate jacket directed away from the compression volume being located at an end of the stator which is directed away from the compression volume or set back therefrom, while conveying means are provided for conveying at least some of the gas arriving at the gas inlet formed in the shell into the chamber containing the motor winding end, and the intermediate jacket has a gas intake orifice opening into the chamber containing the motor winding end, and gas conveyed by the conveying means is admitted into the chamber containing the winding end through the gas intake orifice.

2. The compressor as claimed in claim 1, wherein that part of the motor which is situated on the compression volume side is mounted inside a tube forming the intermediate jacket which, being mounted on the body separating the suction and compression volumes, forms a mounting for the motor, an orifice being formed in the tube, between the body and the motor, to admit refrigerant gas.

3. The compressor as claimed in claim 1 wherein the body separating the suction and compression volumes comprises, on the motor side, a tubular extension forming the intermediate jacket and serving as a housing and mounting for one end of the motor, an orifice being formed in the tubular extension of the body to admit refrigerant gas.

4. The compressor as claimed in claim 1, wherein the motor is mounted on the shell, and its upper end is covered by a cap forming the intermediate jacket in which an orifice is formed to admit refrigerant gas.

5. The compressor as claimed in claim 1, wherein the means for conveying the refrigerant gas from the inlet orifice formed in the shell are a tubular sleeve connecting the orifices formed respectively in the shell and in the intermediate jacket which defines the chamber containing the winding end.

6. The compressor as claimed in claim 5, wherein the sleeve comprises a first tubular part mounted on the shell or on the intermediate jacket covering the motor winding end, and a second tubular part which slides on the outside of the latter and is subject to the action of a spring that pushes it towards the part on which the first tubular part is not mounted.

7. The compressor as claimed in claim 1, wherein the means conveying the refrigerant gas into the chamber containing the winding end comprise a by-pass for some of the gas flow to pass directly into the annular volume between the motor and the shell.

8. The compressor as claimed in claim 1, wherein there is formed in the body at least one opening connecting the chamber containing the winding end to the area containing the drive shaft bearings situated on the compression volume side.

9. The compressor as claimed in claim 1, wherein the principal axis of rotation of the drive shaft is essentially vertical.

10. The compressor as claimed in claim 1, wherein the principal axis of rotation of the drive shaft is essentially horizontal.

* * * * *